United States Patent [19]

Pepi

[11] Patent Number: 4,779,381

[45] Date of Patent: Oct. 25, 1988

[54] CARRIAGE FOR A POLISHING TOOL

[76] Inventor: Alan Pepi, 35-28 87th St., Jackson Heights, N.Y. 11372

[21] Appl. No.: 41,977

[22] Filed: Apr. 24, 1987

[51] Int. Cl.[4] ..... B24B 7/18

[52] U.S. Cl. ..... 51/166 R; 51/166 TS; 51/170 PT; 51/174

[58] Field of Search ..... 51/166 R, 166 TS, 174, 51/175, 176, 177, 166 MH, 170 R, 170 T, 170 PT, 180, 241 CG, 178, 34 C, 59 R

[56] References Cited

U.S. PATENT DOCUMENTS 1,195,780 8/1916 Chappell ..... 51/176

3,197,923 8/1965 Kaczmarek ..... 51/170 R

*Primary Examiner*—Robert P. Olszewski

*Assistant Examiner*—Maurina Rachuba

*Attorney, Agent, or Firm*—Nicholas J. Garofalo

[57] ABSTRACT

A carriage comprises a base mounted on rollers for movement of the carriage under manual guidance over a work surface, a platform supported above the base on coil springs held in place by bolts fixed to the base and extending up through the springs and the platform, a tool mount slidable along the platform parallel to an edge of the platform and adapted to have seated therein an electric polishing tool with its polishing wheel overhanging the edge of the platform above the work surface, and nuts selectively threadable on the bolts against the platform to compress or relax the springs so as to lower or raise the platform and the tool relative to the base and the work surface.

6 Claims, 1 Drawing Sheet

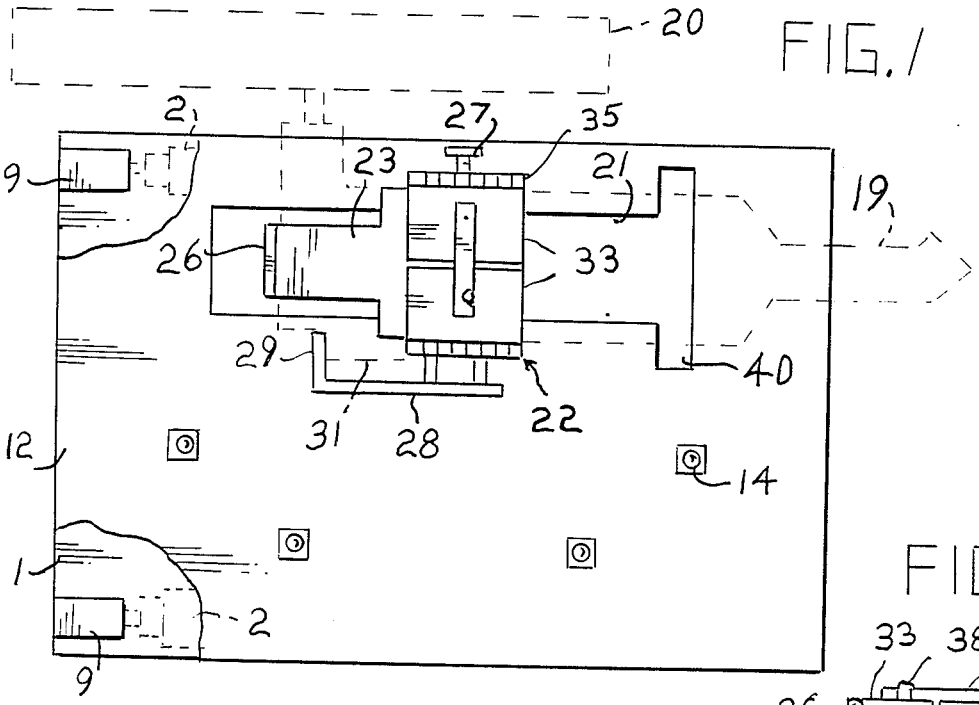
FIG. 1
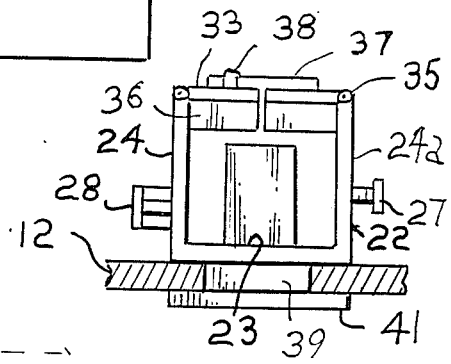
FIG. 3
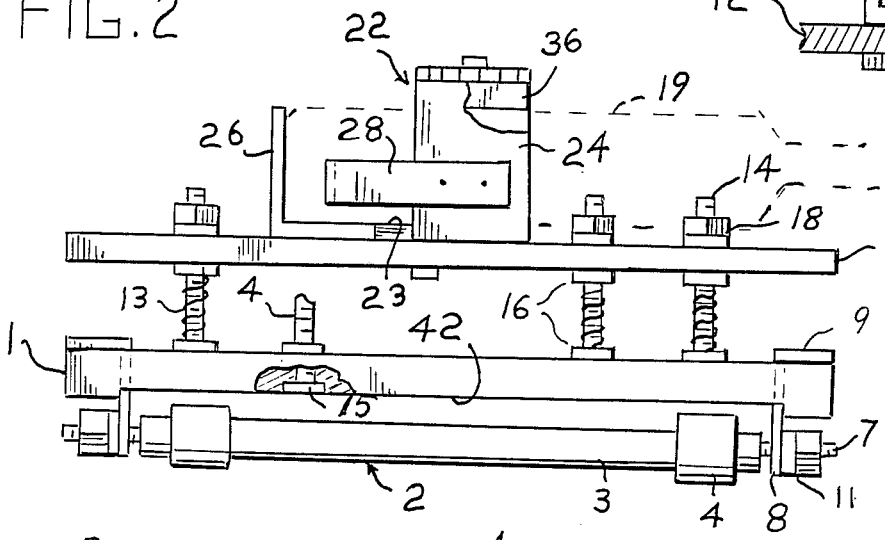
FIG. 2
FIG 4
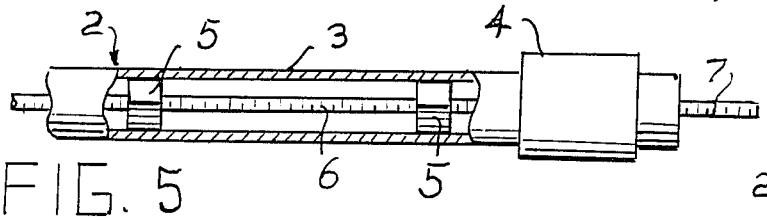
FIG. 5
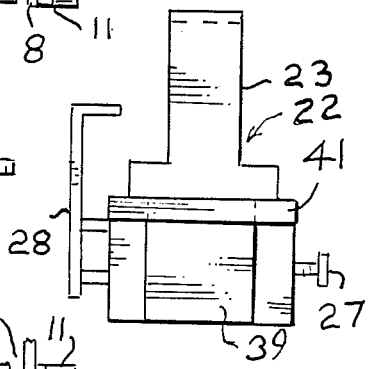
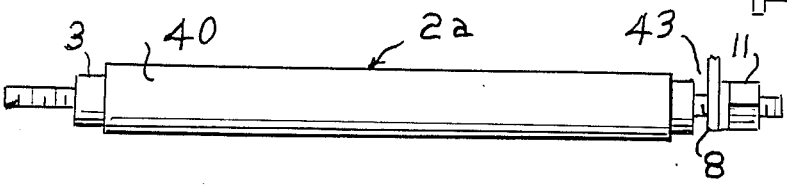
FIG. 6

CARRIAGE FOR A POLISHING TOOL

BACKGROUND OF THE INVENTION

This invention is a carriage for supporting during use a normally handheld electric polishing tool over a work surface.

Polishing tools of the handheld variety have an elongated body terminating in a handle. A drive shaft extending laterally from the body of the tool is adapted to carry at its free end a polishing wheel, such as a sander or a cloth buffer. The conventional tool is heavy, weighing about eight pounds. During use of the tool its body is held raised above a work surface with the polishing wheel contacting the work work surface. Both hands are required to hold the tool in proper relation to the work. Accordingly, when the tool is used in polishing an extended area, the arms of the operator progressively become tired under the weight of the tool, and frequent periods of rest are required to relieve aching muscles. Obviously, with this manner of using the tool, the time for doing large area polishing jobs is undesirably prolonged and the energy spent in doing so is exhausting to the operator.

Further, to obtain a fine finish to the work the tool must be held in a position in which the polishing wheel is maintained at a proper level with a uniform pressure against the work. But, when the arms of the operator become tired, this uniform pressure is difficult to maintain. Accordingly, resulting up and down movements of the tired arms of the operator may result in greater pressure being exerted by the polishing wheel over some areas than others. This may produce a less than evenly polished surface, one having slight waves or depressions in it. This may be particularly so when polishing a conventional polyester or other plastic coated surface.

Now, a general object of the present invention is to provide a carriage as a support for an electric polishing tool of the normally handheld type, and which in supporting the tool will leave the hands of the operator free to merely guide the carriage with the tool thereon over a work surface. The weight of the tool will accordingly be borne by the carriage and not by the operator.

Another object of the invention is to provide a carriage for supporting a normally handheld polishing tool in such manner that the polishing wheel will during its rotation contact the work surface with a uniform pressure throughout a polishing operation.

And a further, though not the last of the objects of the invention, is to provide a carriage for a normally handheld polishing tool which supports the tool upon a platform relative to a base member, wherein the platform is adjustable vertically relative to the base so as to vary, when desired, the degree of pressured contact of the polishing wheel with the work surface.

The foregoing objects and advantages of the invention, as well as others, will become increasingly apparent as this specification continues in further detail.

BRIEF SUMMARY OF THE INVENTION

In accordance with the invention there is provided a carriage having a base member supported on rollers for movement over a work surface, and having a platform supported above the base member on springs. The platform is formed with a channel parallel to one of its sides. A tool mount slidable along the channel is adapted to receive and securely hold against free movement the body of a normally handheld electric polishing tool. When the tool is seated in the tool mount its drive shaft extends over and beyond the edge of the platform, and it is adapted to have mounted thereon a polishing wheel, such as a sander or buffer. The platform is held down upon the springs by nuts threaded on bolts extending upwardly from the base through the springs and above the platform. The nuts may be adjustably tightened or loosened as desired to lower or raise the platform relative to the base and thereby to adjust the degree of contact of the polishing wheel with the work. The tool mount includes means whereby the tool is securely locked therein against relative movement.

When the tool is seated in the tool mount and energized, the operator manually moves the carriage about, as needed. He does this with one hand while holding the handle of the tool with the other hand; and, when desired during a work operation, he may slide the tool mount along the channel. In this manner the polishing wheel is moved as desired to various areas of the work surface.

The foregoing structure of the invention, its features and advantages will become increasingly apparent as this specification unfolds in greater detail and as it is read in conjunction with the accompanying drawing. However, it is to be expressly understood that the drawing is for purposes of illustration and description, and it is not to be construed as limiting the scope of the invention.

BRIEF DESCRIPTION OF THE DRAWING

In the accompanying drawing:

FIG. 1 is a top plan view of a carriage for supporting and moving a normally handheld electric polishing tool relative to a work surface, the polishing tool being shown in broken line;

FIG. 2 is a side elevational view of FIG. 1;

FIG. 3 is a detail of the tool mount, showing its disposition in the channel of the platform for relative sliding movement;

FIG. 4 is a bottom plan view of the tool mount removed from the channel of the platform;

FIG. 5 is an enlarged fragmentary detail of one of the rollers on which the carriage rides; and FIG. 6 is a modified form of the roller; it is preferable for use when the apparatus is to be used in polishing a surface of narrow width.

DETAILED DESCRIPTION OF THE INVENTION

The carriage embodying the invention, as illustrated in the drawing, is a unitary apparatus. It has a panel member or base 1 of rectangular form. It includes a pair of parallel rollers 2 supporting it for movement over a work surface. One of the rollers extends below the border of one side of the base, and the other roller similarly extends below the border of the opposite side of the base.

Each roller has an elongated tubular body 3 of rigid material, such as metal. An annular band 4 of resilient material, such as rubber, is bonded about each end of the roller. The bands serve to provide minimal contact of the roller with a work surface and, accordingly, limit the amount of dust that may collect upon the roller during a work operation.

The roller is mounted on bearing elements 5 for rotation relative to an axially extending shaft 6. The free ends 7 of the shaft project from opposite ends of the roller. Each end of the shaft has a slide fit in a hole of a depending arm 8 of a right-angled bracket. The arm extends upwardly through a slot in the base, and the other arm 9 of the bracket is fixed to the surface of the base.

Here, the roller shaft is threaded throughout its length. It is in the nature of an elongated screw. Nuts and washers 11 mounted on the free ends of the shaft abut with some tension the depending arms 8 of the supporting brackets. The arms 8 are resilient or spring-like, so that the tension exerted against them by the nuts and washers tends to flex the arms to lock the nuts and washers to the shaft, The bearing elements 5 are in the form of nuts threaded upon the shaft. They have slightly rounded corners in bearing contact with the inner surface of the roller. In this arrangement a slight friction is provided by the bearing nuts 5 to the roller; it enables the roller to normally rotate together with the bearing nuts relative to the shaft and, at times, to rotate relative to both the bearing nuts and the shaft. This arrangement has the added advantage of enabling ready removal of the roller and shaft from one another for replacement or repairs. In this respect, the end nuts and washers 11 are first removed and then, while the roller is manually held, the shaft is unscrewed from the bearing nuts 5 and slipped free of the arms 8 of the supporting brackets. The bearing nuts may then be probed free of the roller.

Disposed above and in parallel relation to the rectangular base 1 is a platform 12 of complementary rectangular form. It is preferably of the same length and width as the base. The platform is supported upon a group of coil springs 13 in horizontal and parallel relation to the base. It is held in place by means of a group of bolts 14, here four in number. Each bolt has a headed end 15 seated in a complementary recess at the underside of the base. The threaded shank of each bolt extends slidably up through the related spring, washers 16 abutting the ends of the spring, and through a hole in the platform. Nuts and washers 18 on the projecting ends of the bolts hold the platform securely seated in place upon the springs. The platform is adapted to be adjustably raised or lowered to a desired level relative to the base by tightening or loosening the retaining nuts 18. This action causes the springs to accordingly be compressed or relaxed with a resulting corresponding movement in the level of the platform.

The platform is adapted to support a polishing tool 19, shown in broken line in FIG. 1; and the objective in adjustably raising or lowering the platform is to bring the periphery of the polishing wheel 20 into a desired pressured contact with the work surface, accordingly as the polishing tool is raised or lowered.

The platform has an elongated open channel 21 in its surface which extends parallel to and in close relation to one of the sides of the platform. Seated in and for slidable movement along the channel is a tool mount 22 of U-form in which a conventional normally handheld polishing tool 19 is adapted to be seated.

The tool mount has a flat base or seat 23 and a pair of opposed side walls 24, 24*a* extending vertically up from the seat. The seat extends forwardly beyond the side walls and terminates in a vertically extending stop plate 26. The body of the tool is adapted to be seated on its side in the tool mount between the side walls in such manner that its front end abuts the stop plate 26. A lock screw 27 in side wall 24*a* is adapted to be threaded inwardly into abutment with the body of the tool, whereby the tool is restrained in a locked condition against free movement relative to the tool mount.

An additional means for further securing the tool against free movement relative to the tool mount is provided by an angled side bar 28. The bar is supported in spaced relation to the outer face of side wall 24. It extends forwardly beyond the side wall and terminates in an inwardly extending arm or hook 29 which is designed to abut against a forward shoulder provided by a rib 31 on the backside of the tool. A rear opposite shoulder of the rib is adapted in the seated condition of the tool to abut against a forward end of the side wall 24.

Further means is provided to insure against free upward movement of the tool relative to the tool mount during operation of the tool. This includes a pair of lids 33. One of which is hinged at its outer end 35 to the upper end of side wall 24, and the other lid is similarly hinged to the other side wall 24*a*. A pad 36 of resilient material, such as rubber, is bonded to the underface of each lid. The lids are adapted to be pivoted from an open condition to a closed condition over the open top end of the tool mount so as to abut the pads 36 into pressed engagement with the body of a tool seated in the tool mount. The lids are adapted to be retained in a closed condition over the body of the tool by means of a latch bar 37 pivoted at one end upon one of the lids and adapted to engage by means of a hooked side a pin at 38 on the other lid.

The tool mount is provide with means enabling it to be slidably moved along the channel 21 and to carry the tool with it. To this end, a block 39 adapted for slidable movement along the channel is fixed to the underside of the seat 23 of the tool mount. It is rectangular and preferably of a smooth hard plastic material. Fixed to the underside of the block is a laterally extending retaining bar 41, the ends of which project beyond the sides of the block. In the seated condition of the tool mount in the channel, as indicated in FIG. 3, the block 39 is disposed in the channel and the projecting ends of the retaining bar 41 underlie the platform 12, whereby the tool mount is slidable along the channel and restrained against rising free of it.

The tool mount is, however, adapted to be manually removed from the channel for repairs or replacement. To this end, the channel is T'd at its rear end by means of a cross slot 40. The slot is larger than the width and length of the retaining bar 41. Accordingly, when the tool mount is slid rearwardly and the retaining bar is brought into alignment with the cross slot, the tool mount as a unit together with the tool seated therein may be manually lifted free of the channel and the platform 12.

In making use of the apparatus, the polishing tool 19 is seated on its side in the tool mount and locked therein against undesirable free movement relative to the tool mount. In the seated condition of the tool its drive shaft extends laterally beyond a side of the platform, and the polishing wheel 20 mounted on the drive shaft is disposed in lateral spaced relation to the platform so as to be rotatable clear thereof, as appears in FIG. 1. The nuts 18 on the bolts 14 are then adjustably tightened or loosened to vary the tension of the springs 13, as may be needed to raise or lower the platform 12 to obtain a desired pressured engagement of the periphery of the polishing wheel with the work surface. The tool is then energized and the operator, with one hand holding the handle of the tool and with his other hand gripping the platform, directionally moves the carriage about on its rollers to carry the polishing wheel where needed over the work surface; and, when needed, the operator manually slides the tool mount along the channel to carry the seated tool short distances forwardly or rearwardly to particular areas of the work surface. It is to be noted that the operator does not at any time bear the weight of the tool, but merely guides it over the work surface by means of the carriage and the tool mount.

It is to be further noted that the carriage is structurally well balanced against tipping over when loaded with the weight of the tool. To this end, the base 1 is undercut above the rollers at 42. This provides a low center of gravity to the carriage, and a desirable stability against its tipping over under the weight of the tool. This stability has the added advantage of allowing the polishing wheel to be laterally extended with multiple buffing pads without the added weight of the pads affecting the stability of the carriage.

The carriage may be applied to polishing not only large surface areas but also very narrow areas. When it is applied to large areas, it is preferable that it be equipped with the rollers 2 shown in FIGS. 2 and 5. But, when it is to be applied in polishing a surface area having a width narrower than the length of the rollers 2, it is preferable that the carriage be equipped with rollers 2*a* of the form shown in FIG. 6. This roller has about its periphery a covering 40 of resilient material, such as rubber, extending for substantially its full length. This enables a resilient portion of the roller to support the carriage as it rides over a narrow surface. The resilient outer covering of the roller serves to insure against marking of some surfaces.

At times, particularly when using the apparatus in buffing some work surfaces such as tables and furniture of high quality, it may be desired that the carriage not be rolled over the work surface and that the tool mount alone be used to move the tool and carry the polishing wheel as needed over the work surface. When employing this method, the operator will merely rest the carriage on the work surface and manually slide the tool mount back and forth relative to the platform to carry the tool and polishing wheel as needed relative to the work surface. After polishing of a particular area is completed, the operator will manually lift the carriage and gently reposition it upon another area to be polished. This process will be repeated until the work has been completed.

To insure against possible rotation of the rollers during this method of using the tool on high quality furniture, means is provided for restraining the rollers against rotation. To this end, a slight clearance or play 43 is provided between the ends of the rollers and the depending arms 8 of the roller supporting brackets. The nuts 11 may be tightened sufficiently to flex the spring-like arms 8 into abutment with the ends of the rollers so as to restrain the latter against rotation. A corresponding relaxing of the tension of the nuts will free the rollers for rotation.

While an embodiment of the invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such forms and modifications thereof as might be construed to be within the spirit of the invention when considered in the light of the specification, the drawing and the appended claims.

What is claimed is:

1. A carriage for an electric polishing tool, the carriage comprising: a rectangular base, a pair of rollers mounted in parallel spaced relation to each other to an underside of the base, one of the rollers extending below and substantially for the length of the border of a first edge of the base and the other roller similarly extending below the border of an opposite edge of the base, a rectangular platform, a group of coil springs mounted upon the base supporting the platform above and in parallel spaced relation to the base, a bolt individual to each coil spring, the bolt having a head seated in the base and having a threaded shank projecting up through the related coil spring and exiting slidably through a hole in the platform, a separate nut threaded on an end of the bolt projecting above the platform, the several nuts being subject to adjustment on the bolts for selectively compressing or relaxing the coil springs so as to lower or raise the platform relative to the base, an elongated channel formed in the platform parallel to and bordering the first edge of the platform, and a tool mount seated in the channel having relative slidable movement along the channel under manual guidance of an operator, the tool mount being adapted to have the body of an electric polishing tool seated and retained thereon with a polishing wheel mounted upon a shaft end of the tool overhanging the first edge of the platform above a work surface.

2. The combination of an electric polishing tool and a carriage for supporting and carrying the tool over a work surface, the tool having an elongated body, a drive shaft projecting laterally from the body, and a polishing wheel mounted on a free end of the drive shaft; the carriage comprising a base having a pair of elongated parallel spaced rollers mounted to the underside of opposite edges of the base enabling rolling of the base over the work surface, a platform, a group of coil springs mounted on the base beneath the platform and supporting the platform above and in parallel spaced relation to the base, a tool mount mounted on the platform providing a seat on which the body of the tool is adapted to be seated in such manner that the drive shaft and the polishing wheel overhang an edge of the platform and the work surface, manually adjustable means for selectively compressing or relaxing the springs so as to lower or raise the platform relative to the base, and a channel in the platform extending along the border of said edge in which channel the tool mount is mounted and along which channel the tool mount is slidable under manual guidance relative to said edge.

3. A carriage for supporting an electrically powered polishing tool relative to a work surface, the carriage comprising a rectangular base, a roller mounted to and extending below the border of one side of the base for substantially the length of the border, a similar roller similarly disposed below an opposite side of the base, the rollers enabling rolling of the base over the work surface, a group of coil springs mounted upon the base supporting the platform above and in parallel spaced relation to the base, and a group of screws extending up from the base and through the springs into engagement with the platform; wherein an elongated channel in the platform extends parallel to and along the border of one side of the platform, a tool seat is mounted in the channel and is freely slidable under manual guidance along the channel, the seat being adapted to have the body of an electrically powered polishing tool seated thereon in such manner that a shaft end of the tool overhangs the one side of the platform and a polishing wheel on the shaft end overhangs the work surface, means is provided for retaining the body of the tool onto the seat for movement as a unit with the seat along the channel, and the screws are manually adjustable for selectively raising or lowering the platform relative to the base to bring the polishing wheel of the seated tool into contact with the work surface.

4. A carriage for supporting an electrically powered polishing tool relative to a work surface as in claim 3, wherein means is provided for restraining the seat from rising free of the channel during its movement along the channel.

5. A carriage for supporting an electrically powered polishing tool relative to a work surface as in claim 4, wherein the restraining means is a bar fixed across the underside of the seat and abutting underside portions of the platform bordering the channel.

6. A carriage for supporting an electrically powered polishing tool relative to a work surface as in claim 5, wherein the channel is enlarged across a rear end thereof and the bar is subject upon movement of the seat to the rear end of the channel to become registered with the enlarged portion of the channel and adapted to be lifted through the enlarged portion upon lifting of the seat from the channel.

* * * * *